US005809803A

United States Patent [19]

Stracuzzi

[11] Patent Number: 5,809,803

[45] Date of Patent: Sep. 22, 1998

[54] EARRING

[76] Inventor: Kenneth R. Stracuzzi, 429 Rick Rd., Southampton, Pa. 18966

[21] Appl. No.: 652,103

[22] Filed: May 23, 1996

[51] Int. Cl.[6] ..... A44C 7/00

[52] U.S. Cl. ..... 63/12; 63/13

[58] Field of Search ..... 63/12, 13, 14.1, 63/14.2

[56] References Cited

U.S. PATENT DOCUMENTS

| | | | |
|---|---|---|---|
| 130,771 | 8/1872 | Tryner . | |
| D. 147,213 | 7/1947 | Dawer | D45/9 |
| D. 147,214 | 7/1947 | Dawer | D45/9 |
| 148,390 | 3/1874 | Tappan . | |
| D. 150,185 | 7/1948 | Wrazlowsky | D45/9 |
| D. 160,246 | 9/1950 | Brandano | D45/9 |
| D. 161,286 | 12/1950 | Semensohn | D45/9 |
| D. 161,289 | 12/1950 | Semensohn | D45/9 |
| D. 169,726 | 6/1953 | Bell | D45/9 |
| D. 170,349 | 9/1953 | Bell | D45/9 |
| D. 170,442 | 9/1953 | Bell | D45/9 |
| D. 175,867 | 10/1955 | Sutain | D45/9 |
| D. 189,793 | 2/1961 | Howard | D45/9 |
| 236,935 | 1/1881 | Claude . | |
| D. 301,700 | 6/1989 | Coleman | D11/86 |
| D. 317,422 | 6/1991 | Hardy | D11/42 |
| D. 337,963 | 8/1993 | Gladorisi | D11/1 |
| D. 347,801 | 6/1994 | Church | D11/40 |
| D. 363,894 | 11/1995 | Kerr | D11/40 |
| 718,708 | 1/1903 | Geiger et al. . | |
| 1,602,239 | 10/1926 | Miller . | |
| 1,732,250 | 10/1929 | Wehse . | |
| 1,743,006 | 1/1930 | Prescott-Richardson . | |
| 2,009,537 | 7/1935 | Williams | 63/14 |
| 2,453,485 | 11/1948 | Axtell | 64/14 |
| 2,502,386 | 3/1950 | Mailand | 64/14 |
| 2,513,746 | 7/1950 | Rohr | 181/23 |
| 2,525,195 | 10/1950 | Austrin et al. | 63/14 |
| 2,641,327 | 6/1953 | Balmer | 181/23 |
| 2,914,928 | 12/1959 | Warden | 63/14 |
| 4,282,721 | 8/1981 | Roach et al. | 63/14 R |
| 4,497,186 | 2/1985 | Mason | 63/13 |
| 4,827,738 | 5/1989 | Rothal | 63/14.1 |
| 4,841,745 | 6/1989 | Hudson | 63/12 |
| 4,993,240 | 2/1991 | Pounder | 63/12 |
| 5,181,397 | 1/1993 | Battista | 63/12 |
| 5,184,482 | 2/1993 | Cloud | 63/14.1 |
| 5,327,499 | 7/1994 | Sohayda | 381/68 |
| 5,363,675 | 11/1994 | Carter | 63/14.1 |

*Primary Examiner*—Kien T. Nguyen
*Attorney, Agent, or Firm*—Harness, Dickey & Pierce, P.L.C.

[57] ABSTRACT

A device adapted to be worn on the ear includes a first portion for securely engaging a lower portion of the ear, a second portion for suspending an item of ornamentation adjacent to an upper portion of the ear and an intermediate portion interconnecting the first and second portions. The item of ornamentation is preferably attached to the second portion in an interchangeable manner. In one form, the first portion of the device is integrally formed with the intermediate portion and effectively constitutes a reduced diameter portion. In a preferred form, the intermediate portion is constructed from a continuous length of wire and the second portion comprises a reduced diameter end of the wire. The reduced diameter portion of the wire engages a conventionally formed aperture in the lobe from the ear from the front of the ear and engages a generally conventional ear nut positioned immediately behind the ear. The intermediate portion of the device wraps around the rear side of the ear and is substantially hidden during use.

13 Claims, 3 Drawing Sheets

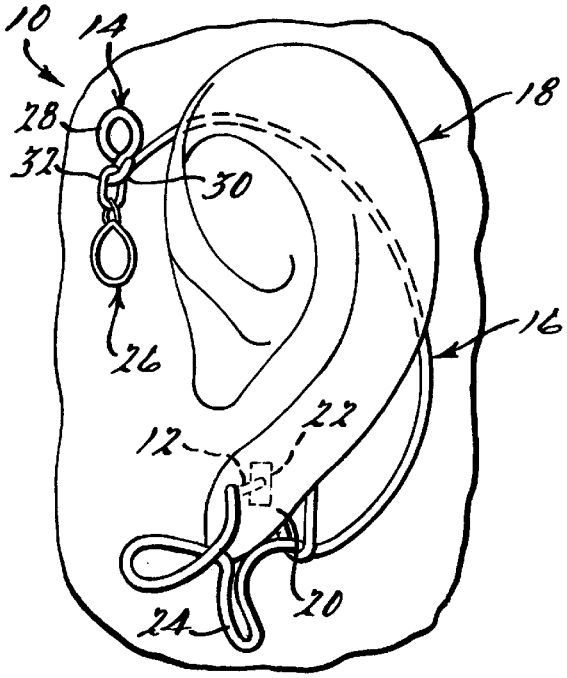
FIG. 1.
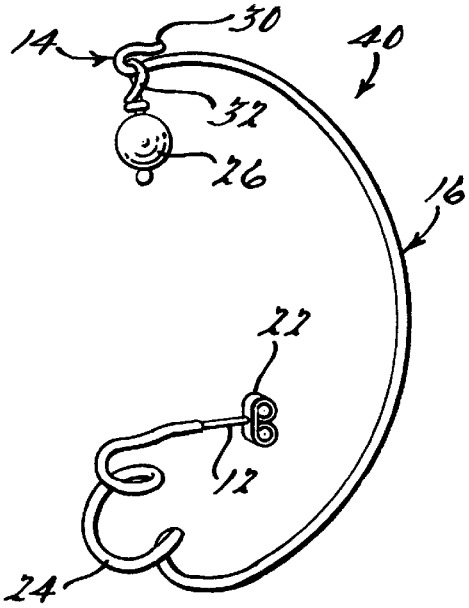
FIG. 2.
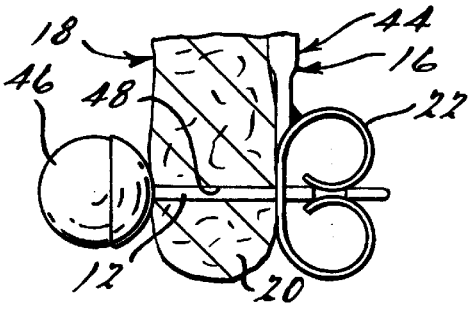
FIG. 3.
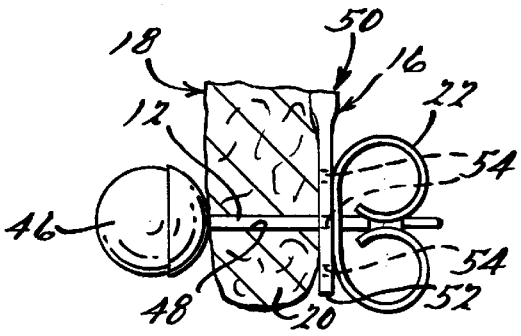
FIG. 4.
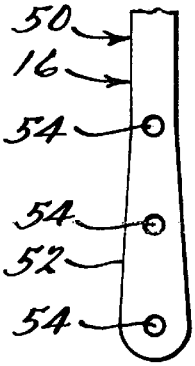
FIG. 5.
FIG. 6.
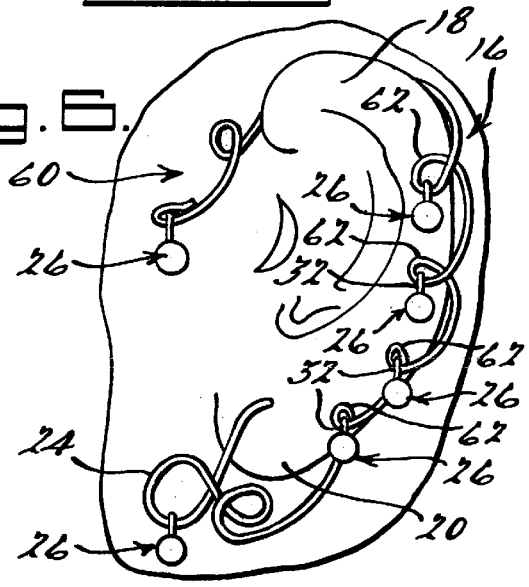

EARRING

BACKGROUND OF THE INVENTION

1. Field of the Invention

The present invention generally relates to the ornamenting of ears. More particularly, the present invention relates to an earring which securely engages a lower portion of the ear and provides an additional position to interchangeably display an item of ornamentation, such as a stone or a charm, which is positioned adjacent to a top portion of a user's ear without the need for further piercing of the ear.

2. Description of the Prior Art

Ear ornamentation in the past has been primarily designed and manufactured to be worn directly on or immediately subjacent the lobe of a user's ear. Such proximity of ear ornamentation is partially attributable to the lack of availability of retaining devices that would allow for alternative positioning of an item of ornamentation, such as a charm holder or the like, about the ear. Conventional attachment to the ear is generally accomplished by a post which passes through an aperture in the lobe of the ear with a retaining device attached to the protruding portion of the post behind the lobe. Alternatively, a wide variety of clamping devices for releasably engaging the lobe of a user's ear have been employed.

Recently, a significant fashion trend has developed which is commonly referred to as body piercing. This trend include the piercing of virtually any imaginable body part. As it is directed to ear ornamentation, body piercing includes the piercing of essentially the entire perimeter of the ear.

While fashionably acceptable an increasingly large segment of the purchasing public, piercing of portions of the ear other than the fleshy ear lobe is associated with increased risks. In this regard, the exterior of the human ear, other than the lobe, is susceptible to infection because it is constructed of cartilage. Such cartilage is not well-nourished by blood like the soft tissue of the ear lobe. Traumatizing of the cartilage from piercing may cause it to break down and tighten into scar tissue, resulting in undesireable physical appearance, infection, or both.

Heretofore, a multitude of different designs have been utilized for accomplishing various ornamental and functional purposes directed to ear ornamentation. In this regard, a number of prior patents disclose devices which encircle a portion of the exterior ear for the suspension of an item of ornamentation adjacent the ear lobe. Some of these patents encircle the entire exterior ear. Examples of such earrings include U.S. Pat. Nos. 1,732,250; 5,184,482; 5,363,675; D301,700; and D347,801. Other prior patents, including U.S. Pat. Nos. 2,009,537; 2,453,485; 2,914,928; 4,827,738 and D337,963 are retained on the ear by surrounding the top, bottom and rear portion of the exterior ear and do not pass in front of the ear. U.S. Design Pat. Nos. 160,246; 169,726; 170,349; and 170,442 teach earring designs which engage a pierced hole in the ear lobe and include an upwardly extending ornamental portion which hooks around an upper portion of the ear for further stability. Finally, U.S. Pat. No. 4,993,240 discloses a device for ear ornamentation which includes a post passing through a conventionally formed ear lobe aperture, a decorative member extending generally downward from the upper front end at the top portion of the wearer's ear and an immediate portion connecting the post and the decorative member.

While prior known designs, including but not limited to those discussed above have proven to be commercially acceptable for a wide range of applications, each is associated with disadvantages. For example, many of the prior designs do not provide for secure attached to the ear, thereby rendering the earring susceptible to loss. Other designs do not permit quick and easy interchangeability of an item of ornamentation. Still other designs do not easily and securely engage the ear lobe in a functionally and aesthetically conventional manner.

Thus, there remains a need in the art for an earring which can be secured to the ear in a conventional manner and which allows the wearer to releasably suspend an item of ornamentation adjacent to an upper portion of the ear.

It is a principal object of the present invention to provide an earring having a first portion secured to the ear in a conventional manner, a second portion for interchangeably suspending an item of ornamentation, such as a charm holder or the like, adjacent to an upper portion of the ear, and an intermediate portion which wraps around the ear and interconnects the first and second portions.

It is a related object of the present invention to permit the suspension of items of ornamentation in close proximity to an upper portion of the ear without requiring piercing of the upper portion of the ear, thereby eliminating the potential for infection.

It is a further object of the present invention to provide a pierced earring which passes through the lobe of the ear and is supported by the ear so as to reduce the potential for tearing of the ear lobe which frequently results from extended wearing of earrings of considerable weight.

SUMMARY OF THE INVENTION

This invention is directed to a method and apparatus which overcome the drawbacks of prior known devices, including those discussed above. In one preferred form, the apparatus of the present invention comprises a device adapted to be worn on a user's ear which has an upper portion, a lower portion, a front side and a rear side. The device includes a first portion, a second portion and an intermediate portion. The first portion is adapted for securely engaging the lower portion of the ear. The second portion provides for the suspension of an item of ornamentation adjacent to the upper portion of the ear. The intermediate portion interconnects the first portion and the second portion. The device allows a user to interchangeably suspended an item of ornamentation adjacent to the upper portion of the ear without requiring piercing of the upper portion of the ear.

BRIEF DESCRIPTION OF THE DRAWINGS

Further objects, features and advantages of the present invention will become apparent from analysis of the following written specification and accompanying drawings and the appended claims in which:

FIG. 1 an environmental view illustrating an earring constructed in accordance with a first preferred embodiment of the present invention operatively engaged with a wearer's ear;

FIGS. 2 is a side view of an earring constructed in accordance with a second preferred embodiment of the present invention;

FIG. 3 is a partial side view of an earring constructed with a third preferred embodiment of the present invention illustrating the wire attached directly to the ear nut;

FIG. 4 is a partial rear view of a earring constructed in accordance with a fourth preferred embodiment of the present invention illustrating the wire retained between the ear nut and ear lobe;

FIG. 5 is a partial rear view of a portion of the earring of FIG. 4, illustrating a plurality of apertures which provide for adjustability;

FIG. 6 is an environmental view of an earring constructed in accordance with a fifth preferred embodiment of the present invention operatively engaged with a wearer's ear illustrating a plurality of decorative elements interchangeably suspended along the length of the intermediate portion;

DETAILED DESCRIPTION OF THE PREFERRED EMBODIMENTS

Figure 7:
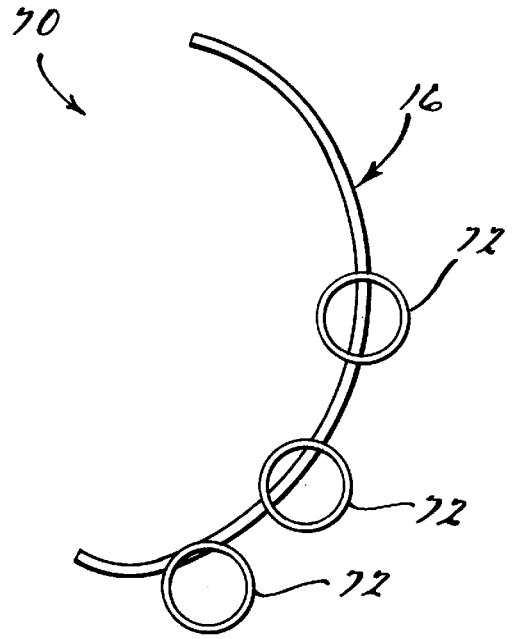
FIG. 7 is a simplified side view of an earring constructed in accordance with a sixth preferred embodiment of the present invention.

As required, detailed embodiments of the present invention are disclosed herein. However, it is to be understood that the disclosed embodiments are merely exemplary of the present invention which may be embodied in various forms. Therefore, specific functional and structural details disclosed herein are not to be interpreted as limiting, but merely as a basis for the claims and as a representative basis for teaching one skilled in the art to variously employ the present invention in virtually any appropriately detailed structure.

Turning generally to the drawings, a number of preferred embodiments of the present invention are illustrated. With initial reference to FIG. 1, an earring constructed in accordance with a first preferred embodiment of the teachings of the present invention is illustrated and has been generally identified with reference numeral 10. The earring 10 is illustrated to generally include a first portion or lobe engaging portion 12, and a second portion or distal end portion 14. The earring 10 further includes an intermediate portion 16 interconnecting the lobe engaging portion 12 and the distal end portion 14.

From a reading of the remainder of this detailed description describing the various embodiments of the present invention, it will become apparent to those skilled in the art that each of the embodiments generally incorporates a lobe engaging portion 12, a distal end portion 14, and an intermediate portion 16. For this reason, these elements and other substantially equivalents are denoted with like reference numerals throughout the drawings. It must further be appreciated that these general elements (e.g. the lobe engaging portion 12, the distal end portion 14, and the intermediate portion 16) may be substituted amongst the various described preferred embodiments to arrive at even more variations within the scope of the present invention.

As shown in the environmental view of FIG. 1, the earring 10 is specifically intended to ornament a user's ear 18. The lobe engaging portion of the earring 10 preferably comprises a stem portion 12 which passes through a conventionally formed aperture in the lobe 20 of the ear 18. As shown in FIG. 1, the stem portion 12 preferably enters the aperture of the lobe 20 from a front side of the lobe 20 and engages an ear nut 22 located behind the lobe 20. In a substantially conventional manner, the ear nut 22 cooperates with the stem portion to releasably attach the earring 10 to the ear 18.

The intermediate portion 16 of the earring 10 is preferably a continuous length of memory retaining wire. As illustrated, the intermediate portion 16 is integrally formed with the stem portion 12, the stem portion 12 effectively being a reduced diameter end of the intermediate portion 16. Adjacent the stem portion 12, the intermediate portion 16 is artistically formed into an ornamental segment 24 which is positioned in proximity to the ear lobe 20 in a position similar that in which a conventional earring is suspended therefrom. While not specifically shown with respect to the first preferred embodiment illustrated in FIG. 1, a charm holder or similar item of ornamentation may be suspended from the ornamental segment 24. In this regard, the stem portion 12 can be passed through the eye of a charm holder until the charm holder is positioned along the ornamental segment 24.

The intermediate portion 16 then wraps around a rear side of the ear 18 substantially hidden from sight from a vantage point forward from the user. The intermediate portion 16 terminates adjacent an upper forward portion of the ear 18 where, preferably, it is integrally interconnected with the distal end portion 14. Among other advantages, wrapping of the intermediate portion 16 about the ear transfers a significant portion of the weight of the earring 10 directly to the upper portion of the ear 18. As a result, the majority of the weight of the earring 10 is not borne by the lobe 20 and the risk of damage to the lobe 20 from continued wearing of heavy earrings is reduced. This is particularly advantageous for larger earring designs of increased weight.

The intermediate portion 16 is preferably constructed of a resilient metal or other suitable material. A degree of adjustability can be incorporated into the earring 10 by utilizing an elastically deformable material capable of retaining its shape within an elastic limit. Such a material allows the user to bend the intermediate portion 16 to conform to the size and shape of his or her particular ear 18.

The distal end portion 14 of the earring 10 is shown to preferably comprise a continuous extension of the wire which forms the intermediate portion 16. Significantly, the distal end portion 14 provides a location displaced from the lobe 20 of the ear 18 for displaying an item of ornamentation 26, such as a gemstone, charm holder or the like. As specifically illustrated, the wire of the distal end portion 14 is bent into a loop 28 and terminates in a hook segment 30. The hook segment 30 is configured to releasably receive a generally circular loop conventionally attached to the item of ornamentation 26.

Preferably, the hook portion 30 is toleranced such that slight urging of the loop 32 is required for the end of the hook portion 30 to enter the loop 32. Such an arrangement minimizes the possibility that the item of ornamentation 26 will be lost, while retaining a degree of interchangeability. As will now be apparent by those skilled in the art, the earring 10 of the present invention allows the user to position the item of ornamentation 26 adjacent an upper portion of the ear 18 without requiring further piercing of the ear 18.

While not specifically shown, the hook portion 30 of the earring 10 can alternatively be replaced with a closed loop. In such an arrangement, the item of ornamentation would be required to be fitted with an attachment portion such as a spring loaded release to engage the closed loop.

With reference now to FIG. 2, an earring 40 constructed in accordance with a second preferred embodiment of the present invention is illustrated. To a significant degree, the earring 40 is substantially identical to the earring 10 of the first preferred embodiment. The earring 40 displaced from the ear 18 for purposes of illustration and 40 provides an ornamental segment 24 and a distal end portion 14 of modestly alternative construction.

With reference to FIG. 3, a portion of an earring 44 constructed in accordance with a third preferred embodiment of the present invention is illustrated. In this third embodiment, the intermediate portion 16 does not include an ornamental segment adjacent to the lobe 20. Rather, the intermediate portion 16 is attached directly to the ear nut 22. Preferably, the intermediate portion 16 is welded or otherwise permanently attached to the ear nut 22 in any of a number of well known manners. This arrangement allows the user to utilize a conventional earring stem 12. As illustrated, a pearl 46 or other item of ornamentation is attached to the stem 12 and the stem 12 is passed through an aperture 48. Immediately behind the ear 18, the stem 12 engages the ear nut 22.

Turning now to FIGS. 4 and 5, an earring 50 constructed with a fourth preferred embodiment of the present invention is illustrated. The earring 50 is similar to the earring 40 of the third preferred embodiment, but differs in that the intermediate portion 16 is not permanently attached to the ear nut. Rather, the intermediate portion 16 is formed to include a flatten end portion 52 including a plurality of apertures 54. Again, the stem 12 of a conventional earring is passed through the aperture 48 of the ear lobe 20. In this embodiment, the stem 12 engages one of the aperture 54 of the flatten end portion 52 before engaging the ear nut 22. By providing a plurality of apertures 54 in the intermediate portion 16, a degree of flexibility is incorporated into the earring 50.

With reference to FIG. 6, an earring 60 constructed in accordance with the teachings of a fifth embodiment of the present invention is illustrated. The earring 60 is similar to a large extent to the earring 40 of the second preferred embodiment. Distinct therefrom, the intermediate portion 16 of the earring 60 of the fifth preferred embodiment is formed to include a plurality of loops 62 along its length. The loops 62 are arranged to be positioned adjacent an outer side of the ear 18 about its perimeter. Each of the loops 62 provides an additional location for suspending an item of ornamentation 26 without the need to further pierce the ear.

In the exemplary embodiment illustrated, the stem portion 12 (not shown) of the earring 60 can be passed through the loop portion 32 of the items of ornamentation and the loops can be displaced along the length of the wire forming the intermediate portion 16 until one is located at each of the loops 62. The fifth preferred embodiment of the present invention further illustrates optional hanging of an item of ornamentation 26 from the ornamental segment 24 of the intermediate portion 16. Thus, the embodiment of FIG. 6 illustrates a plurality of decorative elements interchangeably suspended along the length of the intermediate portion 16.

With general reference to FIGS. 9–13, seven additional preferred embodiments will be described below. The remaining preferred embodiments are primarily illustrated to only include the intermediate portion 16 thereof. In this regard, most of the remaining preferred embodiments are not detailed to include the lobe engaging portion 12 or the distal end portion 14. However, it will be appreciated by those skilled in the art that any of the remaining preferred embodiments may incorporate any suitable lobe engaging portion and any suitable distal end portion, including but not limited to those discussed above with respect to the first through fifth preferred embodiments.

Turning now to FIG. 7, the intermediate portion 16 of an earring 70 constructed in accordance with a sixth preferred embodiment of the present invention is illustrated. As shown, the earring 70 includes a plurality of loops 72 welded or otherwise suitably fastened along the length of the intermediate portion 16. As illustrated, the loops 72 are each of a closed configuration and serve to provide additional locations for the releasable suspension of items of ornamentation 26. Alternative to the illustration of FIG. 7, the loops 72 can be formed of an open configuration to facilitate suspension of an item of ornamentation having a closed loop, such as that shown in FIG. 1 and designated with reference numeral 30.

Figure 8:
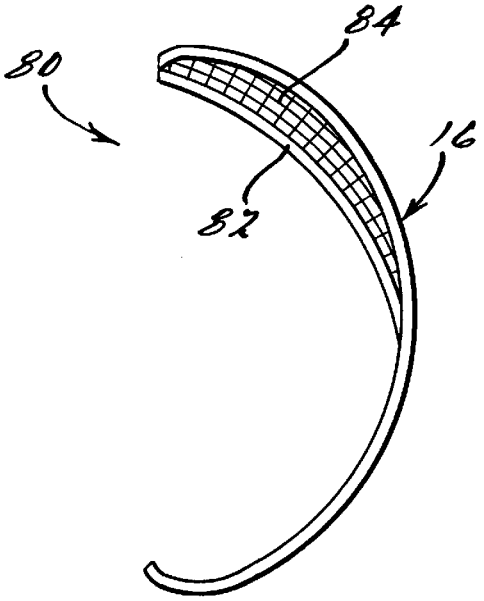
FIG. 8 is a simplified side view of an earring constructed in accordance with a seventh preferred embodiment of the present invention.

With reference now to FIG. 8, the intermediate portion 16 of an earring 80 constructed in accordance with a seventh preferred embodiment of the present invention is illustrated. The earring 80 includes a wire segment 82 which is attached to the intermediate portion 16 adjacent the distal end portion (not shown with respect to the seventh preferred embodiment) and a central section of the intermediate portion. The space between the wire segments 82 and the intermediate portion 16 is preferably bridged by an ornamental metallic grid 84 or other ornamental element. In use, the intermediate portion 16 wraps around the rear of the ear 18 similar to the prior described embodiments, while the wire segment 82 traverses a portion of the front of the ear 18. As a result, the metallic grid 84 effectively "caps" an upper portion of the ear 18.

Figure 9:
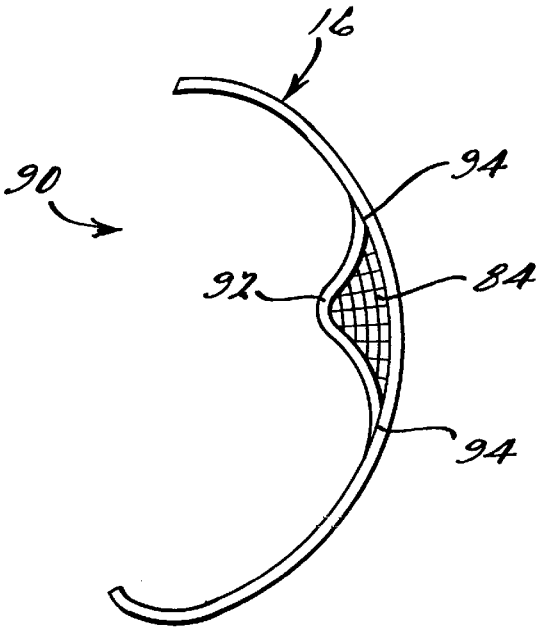
FIG. 9 is a simplified side view of an earring constructed in accordance with a eighth preferred embodiment of the present invention.

In a similar variation, FIG. 9 illustrates an earring 90 constructed in accordance with an eighth preferred embodiment of the present invention. The earring 90 similarly includes a wire segment 92 attached to the intermediate portion 16 at a pair of spaced apart points 94. The wire segment 92 is attached in any of a number of well known manners, including but not limited to welding. In this embodiment, the space between the wire segment 92 and the intermediate portion 16 again is spanned by a wire grid 84. The wire grid 84 is arranged to wrap around the central rear portion of the ear 18 while the intermediate portion 16 remains hidden behind the ear in a manner similar to the earlier discussed embodiments.

Figure 10:
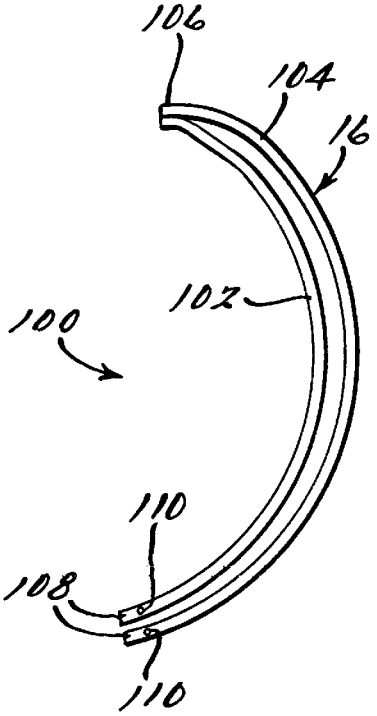
FIG. 10 is a simplified side view of an earring constructed in accordance with a ninth preferred embodiment of the present invention.

With reference now to FIG. 10, the intermediate portion 16 of an earring 100 constructed in accordance with a ninth preferred embodiment of the present invention is illustrated and in this particular embodiment, the intermediate portion 16 is formed to include first and second generally arcuate members 102 and 104. In a manner substantially identical to the embodiments previously described, the first arcuate member 102 is adapted to wrap around the back of the ear 18 and be substantially hidden during use. The second arcuate member 104 is adapted to be disposed adjacent the front portion of the ear 18 along its perimeter. As illustrated, the first and second arcuate members 102 and 104 are integrally formed of a single wire which is bent adjacent an upper end 106 of the intermediate portion 16. Alternatively, the first and second arcuate members 102 and 104 can be formed of two wires which are welded or otherwise permanently affixed adjacent the upper ends. Each of the first and second arcuate members 102 and 104 includes a lower end 108 flattened and including at least one aperture 110. The lobe 20 of the ear 18 is placed between aligning apertures 110 and a generally conventional earring stem 12 (not shown with respect to the ninth preferred embodiment) is passed through each of the apertures 110 and the lobe 20.

Figure 11:
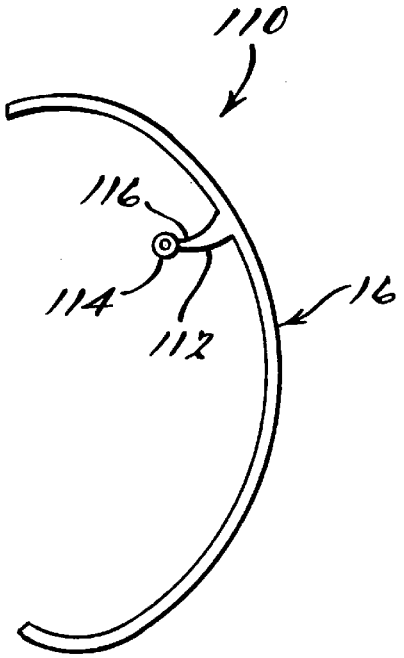
FIG. 11 is a simplified side view of an earring constructed in accordance with a tenth preferred embodiment of the present invention.

With reference now to FIG. 11, the intermediate portion 16 of an earring 110 constructed in accordance with a tenth preferred embodiment of the present invention is illustrated. The earring 110 is shown to include a finger 112 attached to the intermediate portion 16 and arranged and adapted to wrap around a back edge of the ear 18. As a result, the intermediate portion 16 wraps around the back of the ear and is hidden during use, while the finger 112 curves around the front of the ear and provides an additional location for releasably suspending an item of ornamentation 26. A loop 114 or aperture is fixedly interconnected to a distal end 116 of the finger 112. It will be appreciated by those skilled in the art, that in certain applications it may be desirable to provide a plurality of similar fingers 112 along the length of the intermediate portion 16.

Figure 12:
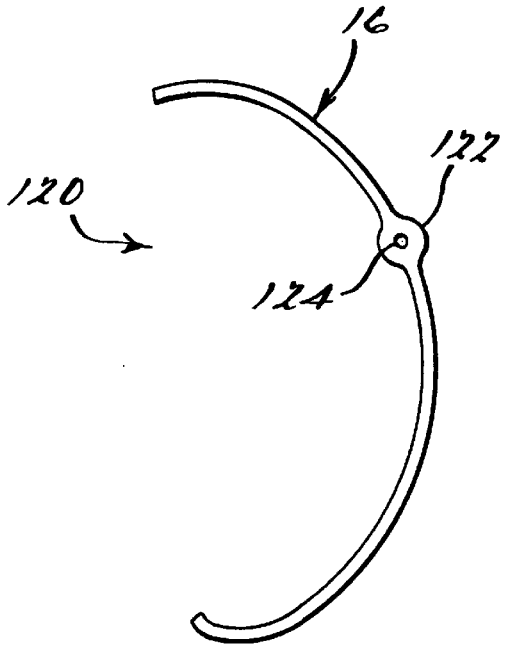
FIG. 12 is a simplified side view of an earring constructed in accordance with a eleventh preferred embodiment of the present invention.

With reference to FIG. 12, the intermediate portion 16 of an earring 120 constructed in accordance with an eleventh preferred embodiment of the present invention is illustrated. In this particular embodiment, the intermediate portion includes a flattened segment 122 formed to include an aperture 124 for receiving the stem 12 (not shown with respect to the eleventh preferred embodiment) of an otherwise conventional earring. As with the prior embodiments, the earring of the eleventh preferred embodiment provides an additional location for interchangeably suspending an item of ornamentation 26 without requiring further piercing of the ear 18.

Figure 13:
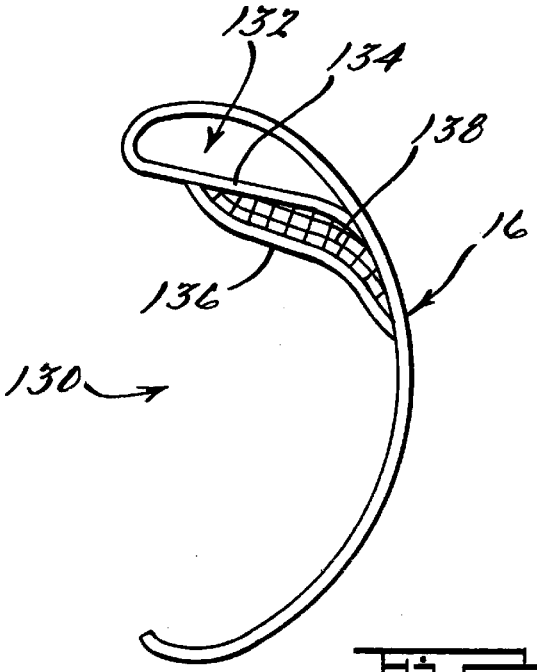
FIG. 13 is a simplified side view of an earring constructed in accordance with a twelfth preferred embodiment of the present invention.

Turning finally to FIG. 13, the intermediate portion 16 of an earring 130 constructed in accordance with a twelfth preferred embodiment of the present invention is illustrated. In the embodiment, the intermediate portion 16 is doubled-over on itself adjacent an upper edge of the earring 130 to define an aperture 132 configured to receive an upper edge of the ear 18. In this regard, a majority of the intermediate portion 16 is disposed behind the ear 18 as with the prior described embodiments while a forward segment 134 wraps around a top front portion of the ear 18 and is welded or otherwise suitably attached to a central section of the intermediate portion 16. Similar to the seventh and eighth embodiments of FIGS. 8 and 9, respectively, the earring 130 also includes a wire segment 136 permanently affixed to spaced apart portions of the intermediate portion 16. Again, the space between the wire segment 136 and the intermediate portion 116 is bridged by a metallic grid 138 for purposes of ornamentation.

While the above description constitutes various preferred embodiments of the present invention, it will be appreciated that the invention is even further susceptible to modification, variation, and change without departing from the proper scope or fair meaning of the accompanying claims. For example, each of the above-described preferred embodiments can be modified to include a generally conventional clamping arrangement for releasably engaging the lobes of ears which are not pierced.

I claim:

1. A device adapted to be worn on the ear, the ear having an upper portion, a lower portion, a front side and a rear side, the device comprising:

a first portion for securely engaging the lower portion of the ear for entering the ear in a first direction;

an item of ornamentation;

a second portion for suspending said item of ornamentation adjacent to the upper portion of the ear, said second portion for extending from the ear in a second direction substantially opposite said first direction; and an intermediate portion interconnecting said first portion and said second portion;

whereby said item of ornamentation is interchangeably suspended adjacent to the upper portion of said ear without requiring piercing of said upper portion of said ear.

2. The device adapted to be worn on the ear of claim 1, wherein said intermediate portion is adapted to wrap around the rear side of said ear and is generally hidden during use.

3. The device adapted to be worn on the ear of claim 2, wherein said intermediate portion comprises a continuously formed length of wire.

4. The device adapted to be worn on the ear of claim 3, wherein said first portion comprises a first end of said continuous length of wire, said first end having a reduced diameter and adapted to pass through an aperture in the lower portion of the ear.

5. The device adapted to be worn on the ear of claim 4, wherein said intermediate portion includes a decorative section adjacent said first portion.

6. The device adapted to be worn on the ear of claim 4, wherein said first end is adapted to enter the aperture from the front of the ear.

7. The device adapted to be worn on the ear of claim 3, further comprising an ear nut attached to said continuous length of wire.

8. The device adapted to be worn on the ear of claim 7, wherein said first portion comprises a first end of said continuous length of wire, said first end engaging said ear nut.

9. The device adapted to be worn on the ear of claim 1, wherein said item of ornamentation is interchangeably suspended from said second portion.

10. A device adapted to be worn on the ear, the ear having an upper portion, a lower portion, a front side and a rear side, the device comprising:

an item of ornamentation; and a wire unitarily configured to include a first end portion having a reduced diameter end adapted to pass through an aperture in the lower portion of the ear for entering the ear in a first direction, an intermediate portion adapted to wrap behind the ear so as to be substantially hidden during use, and a second end portion for suspending said item of ornamentation adjacent to an upper portion of the ear, said second portion for extending from the ear in a second direction substantially opposite said first direction.

11. The device adapted to be worn on the ear of claim 10, wherein said intermediate portion includes a decorative section adjacent said first portion.

12. The device adapted to be worn on the ear of claim 10, wherein said item of ornamentation is interchangeably suspended from said second portion.

13. The device adapted to be worn on the ear of claim 10, wherein said first end is adapted to enter the aperture from the front of the ear.

* * * * *